US008231018B2

(12) United States Patent
Gassner

(10) Patent No.: US 8,231,018 B2
(45) Date of Patent: Jul. 31, 2012

(54) SCREW CLOSURE WITH TAMPER-PROOF STRIP

(75) Inventor: Okten Gassner, Odernheim (DE)

(73) Assignee: Bericap GmbH & Co. KG., Budenheim (DE)

( * ) Notice: Subject to any disclaimer, the term of this patent is extended or adjusted under 35 U.S.C. 154(b) by 29 days.

(21) Appl. No.: 12/675,260

(22) PCT Filed: Aug. 12, 2008

(86) PCT No.: PCT/EP2008/060600

§ 371 (c)(1),
(2), (4) Date: Mar. 23, 2010

(87) PCT Pub. No.: WO2009/027227

PCT Pub. Date: Mar. 5, 2009

(65) Prior Publication Data

US 2010/0308050 A1 Dec. 9, 2010

(30) Foreign Application Priority Data

Aug. 30, 2007 (DE) ..... 10 2007 041 365

(51) Int. Cl.
*B65D 41/34* (2006.01)
*B65D 41/32* (2006.01)

(52) U.S. Cl. ..... 215/252; 215/254; 215/256

(58) Field of Classification Search ..... 215/252, 215/256, 254

See application file for complete search history.

(56) References Cited

U.S. PATENT DOCUMENTS

| | | | | |
|---|---|---|---|---|
| 4,546,892 | A | 10/1985 | Couput | |
| 4,981,230 | A * | 1/1991 | Marshall et al. | 215/252 |
| 5,007,545 | A | 4/1991 | Imbery, Jr. | |
| 5,058,755 | A * | 10/1991 | Hayes | 215/252 |
| 5,080,246 | A * | 1/1992 | Hayes | 215/252 |
| 5,660,290 | A * | 8/1997 | Hayes | 215/252 |
| 6,119,883 | A * | 9/2000 | Hock et al. | 215/252 |
| 6,673,298 | B2 * | 1/2004 | Krueger | 264/295 |
| 7,344,039 | B2 * | 3/2008 | Bixler et al. | 215/252 |
| 2002/0079618 | A1 * | 6/2002 | Krueger | 264/328.1 |
| 2003/0098285 | A1 * | 5/2003 | Gregory et al. | 215/252 |
| 2005/0189312 | A1 * | 9/2005 | Bixler et al. | 215/252 |
| 2007/0090080 | A1 * | 4/2007 | Lohrman et al. | 215/305 |
| 2007/0251911 | A1 * | 11/2007 | Russell | 215/252 |
| 2009/0057261 | A1 * | 3/2009 | Ma et al. | 215/252 |

FOREIGN PATENT DOCUMENTS

| | | | |
|---|---|---|---|
| DE | 202004015939 UI | | 1/2005 |
| DE | 10 2007 005 595 | A1 | 8/2007 |
| DE | 10 2007 005 594 | A1 | 8/2008 |
| JP | 2001-72102 | A | 3/2001 |
| WO | 83/03809 | | 11/1983 |
| WO | 2005/067588 | A2 | 7/2005 |

* cited by examiner

*Primary Examiner* — Mickey Yu
*Assistant Examiner* — Niki Eloshway
(74) *Attorney, Agent, or Firm* — Paul & Paul

(57) ABSTRACT

The present invention relates to a screw closure with tamper-proof strip, wherein the screw closure (10) has a tamper-proof strip connected to the lower edge of the cap skirt (2) by way of an easily tearable connection (8). The strip being in the form of a flexible strip (3), comprising a first portion (4) directed downward from the cap skirt (2) and a second portion (5) which is attached at the lower end of the first portion (4), and which is folded over inwardly and back in the direction of the head plate (1). At least one extension (7) is provided in axial extension of the second portion (5), the extension being attached to the outer free edge of the inwardly folded-over second portion (5), and leaving the inner edge thereof free. The second portion has at least one recess and extends along the inner circumference of the screw closure.

9 Claims, 4 Drawing Sheets

SCREW CLOSURE WITH TAMPER-PROOF STRIP

Figure 1:
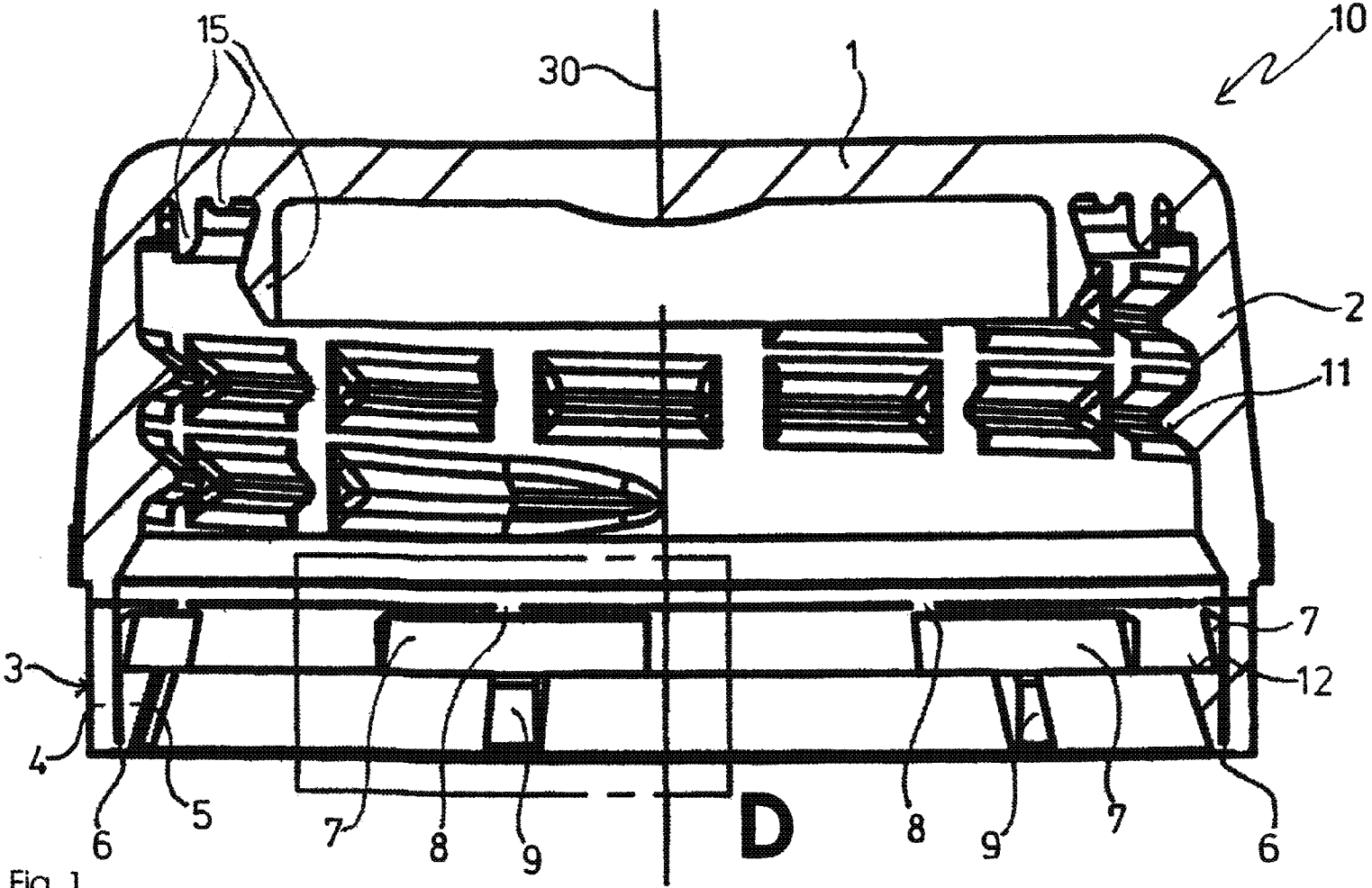

The present invention concerns a screw closure having a tamper-proof strip, wherein the closure has a head plate, an at least approximately cylindrical cap skirt comprising a female screwthread and the tamper-proof strip connected to the lower edge of the cap skirt by way of an easily tearable connection, the strip being in the form of a flexible strip comprising a first portion directed downwardly from the cap skirt and a second portion which is attached at the lower end of the first portion and which is folded over inwardly and back in the direction of the head plate, for engaging behind a securing ring on a container neck, wherein at least one extension is provided in axial extension of the second portion, the extension being attached substantially to the outer free edge of the inwardly folded-over second portion and leaving the inner edge thereof free, wherein the second portion extending along the inner periphery of the screw closure has at least one opening.

A corresponding closure is known from German Utility Model No 202 004 015 939 U1. In addition such a closure is also known from earlier German patent application No 10 2007 005 595 to the same applicants, which however was not yet published at the filing date of the present application.

Such closures with a tamper-proof strip in the form of a flexible strip operate in such a way that the second portion of the flexible strip, which is folded over inwardly and upwardly, when the closure is fitted on to or screwed on to a container neck, slides relatively easily and generally more simply over a securing ring on the container neck, than is the case with conventional tamper-proof strips which differ from the flexible strips being discussed here, in that in those the second portion of a flexible strip is omitted, and instead thereof the first portion has a radially inwardly projecting, nose-shaped projection which must slide over the securing ring, with that first portion being enlarged, in order then to come into engagement with the underside of the securing ring, with a substantially horizontal or slightly inclined and upwardly facing projection surface of the nose-shaped projection. Those conventional closures occasionally involve malfunctions such that either the tamper-proof strip is already damaged upon being fitted on to the container neck or, when the closure is unscrewed, it slides over the securing ring without being damaged or it can be moved over the securing ring by means of suitably introduced tools without suffering damage.

Flexible strips in contrast, by virtue of the elastic connection between the first portion and the second portion, have a tendency for the second portion in its folded-over condition to be pivoted or pressed radially inwardly with its upper inner edge and thus to engage behind a securing ring uniformly and without play. In that case for improved centering, some flexible strips as are described in the aforementioned industrial property rights have extensions or prolongations of the second portion, which, when a closure is fitted completely on to a bottle neck, bear from the outside against the peripheral surface of the securing ring, in which case the projections are provided radially so far outwardly at the free ends of the folded-over second portion that, radially within same, a large part of the engagement surface at the free end of the second portion is still in engagement with the lower surface of the securing ring or is disposed in directly opposite relationship therewith. The permanently elastic deformation experienced by the second portion or the elastic hinge joint thereof with the first portion means that the second portion bears securely against the securing ring along the entire periphery of the closure and is therefore held fast by the securing ring when the closure is unscrewed, whereby the easily frangible bridge portions or the easily tearable connection between the cap skirt and the tamper-proof strip tears or tear and thus the tamper-proof strip remains hanging in place under the securing ring so that, after the closure is first opened, it is always possible to see that the closure has already once been opened.

In the case of Utility Model DE 202 004 025 939 the inner portion of the flexible strip is present only in the form of a large number of mutually separated, segment-like projections which are respectively separated from each other by an aperture or an opening and which each individually are connected by way of a hinge-like connection to the continuously peripherally extending first portion of the flexible strip. At its top side, each of the segments of the second portion of the flexible strip bears a small extension which is arranged in the proximity of the outer edge of the upper surface (in the folded-over condition) of the second portion and thus does not interfere with the engagement of the top side of the second portion with the underside of a corresponding securing ring on the bottle neck, but at the same time bears against the outside of the securing ring and holds the closure in an overall uniformly centered condition. The division of the second portion into a large number of individual segments which are separated from each other by apertures or openings increases the mobility of that second portion in relation to a continuously peripherally extending flexible strip. It will be noted however that it is precisely in their lower portion where they markedly narrow and blend into the hingedly movable portion at the transition to the first portion, that those individual segments have only a low level of inherent stiffness and are easily deformed precisely in that region. Under some circumstances the result of this can be that, particularly when the closure is only loaded at one side upon being unscrewed, the individual segments 'unfurl' over their lower transition to the first portion, that is to say the hinge portion which separates the inwardly folded inner second portion from the outer portion is displaced into the second portion so that the latter is unfolded downwardly out of the position of facing in the direction of the head plate, and folds over, so that it is directed substantially downwardly from the lower edge of the first portion.

It will be appreciated that the terms 'up' and 'down' relate to the normal orientation of a corresponding closure when it is fitted on to a bottle neck, that is to say the head plate of the closure is disposed 'up' and the flexible strip is disposed 'down' on the closure. In relation to the flexible strip in that respect it is presumed that the second portion is always in the upwardly folded-over condition.

In the case of DE 10 2007 005 594 the individual segments extend over a substantially larger peripheral angle and in that case the openings between the individual segments also do not extend over the entire height of the second portion but substantially only over the upper half to the upper two thirds of the (folded-over) second portion while the second portion forms a peripherally extending closed ring in its lower region adjoining the hinge portion. Here too, at their free upper ends, the individual segments have axial extensions which (in the folded-over condition of the second portion) are attached to the radially outer edge thereof and in other respects bear in the same manner against the outside of the securing ring on a container neck when the closure is fitted completely thereonto. In this case also the extensions provide for a corresponding centering effect without however adversely affecting the engagement of the upper surface of the second portion with the underside of the securing ring.

Admittedly, because of the larger segments and the fact that the openings do not extend so deeply in this construction, the risk of the second portion 'folding over' or 'unfurling' is less pronounced, but cannot be excluded with absolute certainty even with this type of closure.

In comparison with that state of the art the object of the present invention is to provide a closure having a tamper-proof strip with the features set forth in the opening part of this specification, which admittedly still has the advantage of easy applicability but at the same time also has increased functional reliability in that it opposes greater resistance to unrolling across the lower hinge region so that it is practically impossible to release the closure by turning over the second portion of the tamper-proof strip.

That object is attained in that the extension extends in the peripheral direction over any opening provided in the second portion.

If there are a plurality of openings, it will be appreciated that either an extension simultaneously extends over a plurality of openings or however a respective extension extends over at least one respective opening.

The fact that a corresponding opening on the second portion is bridged over increases its stability and resistance to the above-described 'unfurling operation'.

Even if hereinafter reference is always made to a multiplicity of openings and extensions, it will be appreciated that the invention also embraces a variant in which there is only one opening and/or only one extension.

In accordance with an embodiment of the invention the openings can extend downwardly to or into the hinge region at the transition to the first portion and/or in the other direction to the axially free (upper) end of the second portion where they are then bridged over by the extension or extensions.

In particular in accordance with an embodiment the openings are in the form of through apertures in the second portion, that is to say they extend in the radial direction completely through the second portion of the flexible strip and thus in that region form a true interruption in the second portion. It will be appreciated however that the openings do not necessarily have to extend completely through the second portion but could also be provided in the form of a markedly reduced wall thickness, which improves the mobility of the segments on both sides of such an opening and relative to each other and thus also improves applicability of the closure to a corresponding bottle neck. Equally the openings can also extend only over a part of the axial height of the second portion and for example can involve a certain spacing both relative to the hinge region at the transition to the first portion and also to the upper engagement surface of the second portion.

An embodiment of the present invention however provides that the openings extend substantially over the entire axial height of the second portion and then are bridged over by an extension or the extensions at the upwardly disposed side of the folded-over second portion of the flexible strip.

In accordance with an embodiment the extensions, starting from their free upper end where they are radially somewhat thicker, radially continuously narrow downwardly, that is to say in the direction of their connection to the second portion. The second portion of the flexible strip itself can be of a similar cross-sectional shape.

In accordance with an embodiment the second portion and selectively also the respective extensions are in cross-section approximately in the form of an acute triangle with a downwardly facing and capped point and the extensions are so fitted on to the upper side of the second portion that the extension is attached only at the radially outer edge of the surface of the second portion. In that case desirably the radial thickness of the second portion, in particular in the region of the connection between the second portion and the extension, is markedly greater than the radial thickness of the extension, thereby ensuring that the extension or extensions, when bearing against the outside of the securing ring, nonetheless leave free the top side of the second portion, for overlapping engagement with the underside of the securing ring. The extension can however also be of substantially any other cross-sectional shape (for example rectangular) as long as it just performs its main function, namely stabilisation of the second portion, and does not interfere with engagement of the top side of the second portion with the underside of the securing ring.

As the extensions are precisely arranged in such a way that they overlap the openings or through apertures, they impart to the second portion a higher level of stiffness which effectively prevents the second portion from unfurling or unrolling, especially when the extensions bear against the outside of the securing ring. Desirably in that respect the extensions are of such a dimension in their radial thickness that they substantially fill up the annular gap remaining between the first portion or the lower edge of the cap skirt and the outer peripheral surface of the securing ring. The result of this is that the second portion is oriented in substantially axis-parallel relationship, which imparts thereto once again better stiffness and a higher level of resistance to unfurling, when coming into engagement with the underside of the securing ring, during a closure unscrewing process.

Desirably the number of through apertures in the second portion is limited to a maximum of twelve, still better to a maximum of ten or eight and in particular six. The purpose of the through apertures is inter alia to provide that, in the case of aseptic closures, cleaning fluids into which the closures are dipped prior to being applied to the corresponding containers can better drain out of the closure. Also any residual moisture which after the closure is applied to a container neck may possibly still be present between the closure and the container neck (outside the seals) can better evaporate by virtue of suitable openings or through apertures.

For that purpose it is also desirable if the through apertures extend substantially over the entire axial height of the second portion (without the extensions), that is to may from the lower hinge region to approximately the upper surface which is opposite to the underside of the securing ring. In another embodiment of the invention it would also be possible for the through apertures to be axially somewhat shorter so that the upper surface thereof, that is in opposite relationship to the underside of the securing ring, is closed and the through aperture begins only at a spacing relative to that upper surface. Nonetheless this embodiment also has additional extensions which, after application of a corresponding closure, bear against the outside of a securing ring and provide for reliable centering and substantially axial orientation of the second portion. It will be noted however that in this case it would not be absolutely necessary for the extensions to be arranged over the through apertures, but rather they can be distributed segment-wise over the upper edge of the second portion without having to pay attention to the peripheral position at which those extensions are present. Preferably however those extensions should nonetheless be segmented and arranged over the respective through apertures in order on the one hand to improve the stability of the second portion in the desired manner without on the other hand making it difficult to fit the closure on to the container neck and in particular move the tamper-proof strip over the securing ring.

In accordance with an embodiment it is provided that the openings or through apertures extend in the lower region of the second portion into the proximity of the transitional or hinge portion connecting the second portion to the first portion of the flexible strip.

The flexible strip, more precisely the upper end of the first portion of the flexible strip, is joined to the lower edge of the cap skirt by way of easily frangible bridge portions. Those bridge portions are for example in the form of a plurality of narrow legs which are distributed over the periphery and which are axially very short and which incidentally hold the flexible strip at a short uniform spacing beneath the lower edge of the cap skirt. Alternatively however at that location the closure may also have a tear line, that is to say a closed, peripherally extending, film-like connection which can be produced by suitable weakening of the wall material between the lower edge of the cap skirt and the upper edge of the tamper-proof strip and which tears under a corresponding loading.

Finally the invention is also intended to embrace embodiments in which the tamper-proof strip does not tear completely away from the cap skirt, but is and remains joined firmly to the cap skirt at one or also a plurality of peripheral positions, in which case however there are also easily tearable connections to the cap skirt between those firm connecting locations and the flexible strip is optionally of such a configuration that it also has one or more separation locations extending through the flexible strip transversely, that is to say substantially in the axial direction, the separation locations providing that the flexible strip tears apart during the loading occurring during the unscrewing movement, at least one peripheral position, so that the fact that the closure has been first opened also remains permanently visible as a result.

Figure 2:
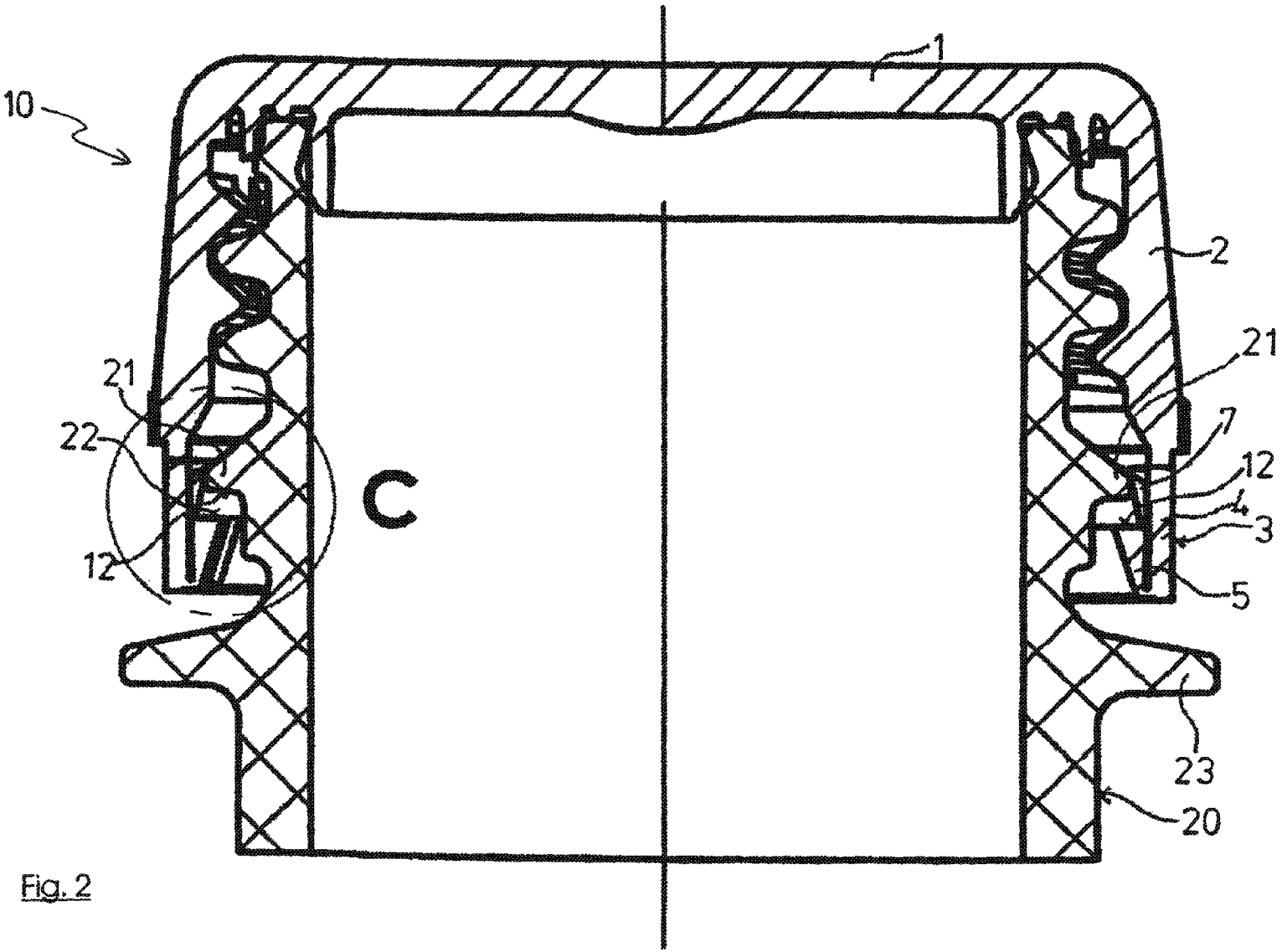
Figure 3:
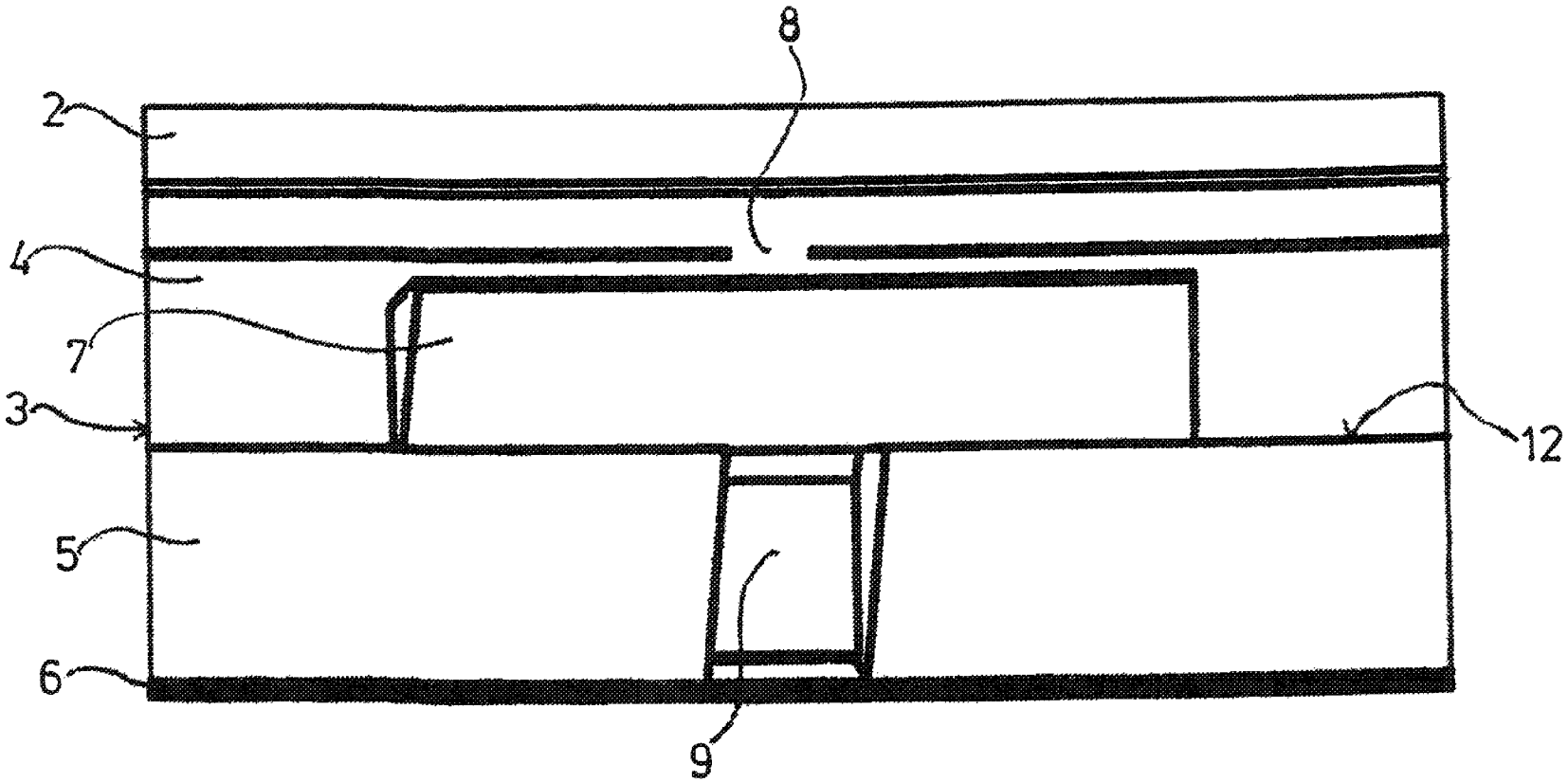
Figure 4:
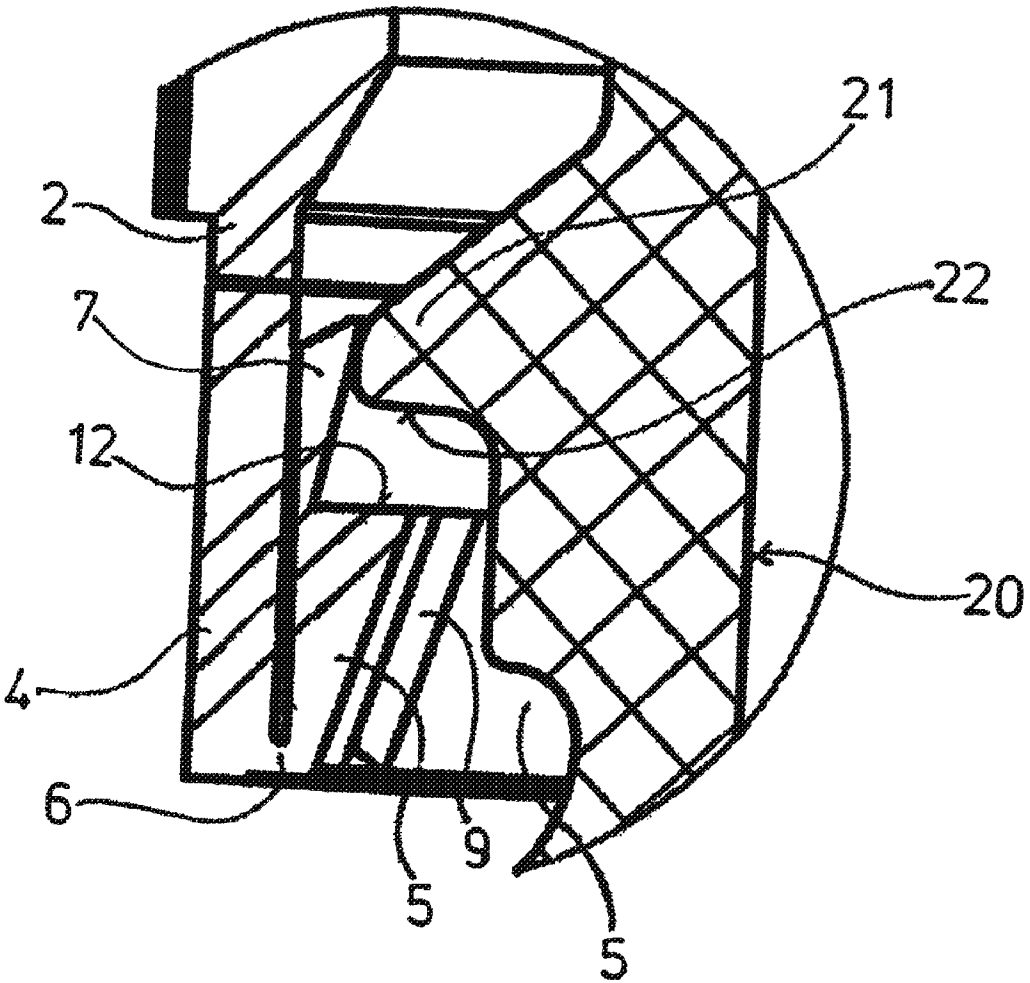

Further advantages, features and possible uses of the present invention will be apparent from the description hereinafter of a preferred embodiment and the accompanying Figures in which:

FIG. 1 shows a diametral axial section through a closure cap according to the invention, FIG. 2 in turn shows a diametral section through a closure cap applied to a bottle neck, FIG. 3 shows a view on an enlarged scale of the rectangular portion marked by D in FIG. 1, from the lower region of a closure cap, and FIG. 4 shows a view on an enlarged scale of the circular portion marked by C in FIG. 2.

Referring to FIG. 1 shown therein is a closure cap which is generally denoted by reference 10 and which substantially comprises a head plate 1 in the form of a circular disk with a cap skirt 2 which is attached at the outside periphery thereof and which in turn has a female screwthread 11. Further inwardly, some sealing elements 15 also extend downwardly from the head plate 1 but they are not further of significance at this juncture and are therefore only summarily described.

It is possible to see at the lower edge of the cap skirt 2 the peripherally extending tamper-proof strip 3 which is in the form of a flexible strip and accordingly comprises a first portion 4 extending substantially vertically as a prolongation of the cap skirt 2 and a second portion 5 which is attached at the lower end of the first portion 4 by way of a kind of bending hinge 6 and which is folded over inwardly and upwardly, that is to say back in the direction of the head plate. At its axially free end or at the upper surface 12, that second inner portion 5 of the flexible strip 3 additionally also has extensions 7 which, as can be seen in particular at the left and right edges of FIG. 1, are attached only at the radially outer upper edge of the second portion 5 and thus leave the upper side 12 of the second portion 5, that extends substantially horizontally, that is to say perpendicularly to the axis 30 of the closure, free in the radially inner region thereof.

Insofar as the terms 'up' and 'down' are used in the present description they always refer to the orientation of the closure as is shown in FIG. 1 and in which the head plate 1 is disposed upwardly, in which respect, in relation to the second portion 5 of the flexible strip 3, the folded-over condition as is shown in FIG. 1 and also in the other Figures is also always described in that orientation. It will be appreciated that, when manufacturing the closure, the second portion 5 extends downwardly in the opposite direction (downwardly), that is to say substantially as an axial prolongation of the first portion 4, and is only folded over into the condition shown in the Figures after the manufacturing process, in which case that folding-over movement is facilitated on the one hand by the relatively thin, almost film-like hinge region 6 and on the other hand also by the openings or through apertures 9 which are distributed over the periphery of the second portion 5.

The flexible strip 3, more precisely the first portion 4 thereof, is connected to the lower edge of the cap skirt 2 by way of easily frangible bridge portions 8.

As will be seen, provided along the periphery of the second portion of the flexible strip 5 are a plurality of through apertures 9, wherein the total number of the through apertures 9 in the illustrated embodiment is six, which however is not necessarily predetermined as the number of through apertures 9 could equally well also be markedly greater or smaller. An excessively large number of through apertures 9 however is less preferred as the through apertures 9 adversely affect the second portion 5 and thus the stiffness and strength thereof, which is to be improved by the present invention and which is required for proper functioning of the flexible strip.

FIG. 2 shows the closure 10 in a condition of being applied to a bottle neck 20. For that purpose the closure 10 is screwed on to the bottle neck 20 or, in given embodiments and depending on the respective specific configuration of the screwthread 11, it is simply axially pressed on. In that case in particular the second portion 5 of the flexible strip and in particular the upper part, which projects in a nose-shaped configuration, must be moved past the securing ring 21 of the bottle neck. The top side of the securing ring 21 is in the form of an inclined run-on surface and the lower part of the flexible strip 3 has a rounded-off lower edge by virtue of the second portion 5 being folded back about the bending hinge 6, in which case also the radially inner surface of the second portion 5 forms a downwardly enlarging conical run-on surface, which permits uniform gradual stretching of the flexible strip 3 and in particular the second portion 5 thereof. That stretching effect is necessary because the second portion 5 of the flexible strip 3, in the unstretched condition, is of a markedly smaller (minimum) diameter than the securing ring 21. While the second portion 5 is sliding on to or over the securing ring 21 accordingly the second portion 5 is pressed against the first portion 4 and the nose-shaped projection at the upper edge of the second portion 5 can also be compressed somewhat until the second portion 5 has slid past the region of the securing ring 21 of the maximum outside diameter and then elastically springs back and engages behind the lower edge of the securing ring 21. By virtue of the large spacing of the easily tearable bridge portions 8 from the second portion 5 of the flexible strip 3, the easily tearable connecting elements 8 between the first portion 4 and the cap skirt 2 are scarcely loaded while the second portion 5 is sliding over the securing ring 21.

After application of the closure cap 10 to the bottle neck 20 in the manner shown in FIG. 2, the upper surface 12 of the second portion 5 of the flexible strip 3, that extends approximately horizontally or perpendicularly to the axis 30, and the lower, also almost horizontally extending surface 22 of the securing ring 21, are disposed in mutually opposite relationship. It will be appreciated that both the surface 12 and also the surface 22 could be more or less greatly inclined with respect to the horizontal, in which respect however that angle of inclination should not exceed a value of for example 30° because otherwise the danger becomes too great, that the second portion 5 also expands when the closure cap 10 is being unscrewed from the container neck 20 and slides on to the securing ring 21 without the easily tearable connections 8 tearing and thus making it apparent that the closure has been opened for the first time.

The lower holding ring 23 on the bottle neck serves substantially to simplify mechanical handling of the bottle in the filled and also unfilled condition and during the manufacturing process, but it additionally also has the effect that the lower edge of the closure cap and in particular of the flexible strip 3 is not readily accessible so that manipulations on the closure by enlarging and lifting the flexible strip 3 over the securing ring 21 can be substantially excluded.

The extensions 7 also contribute to that, which, as can be seen from FIG. 2, are of such a size that they do not slide over the securing ring 21 even when the closure 10 is completely applied to a bottle neck 20, but rather bear against the outer peripheral surface thereof. Those extensions 7 thus hold the second portion 5 of the flexible strip in an erect, almost axis-parallel and centered condition (insofar as this can be said by virtue of the shape of the second portion 5) and prevent the second portion 5 being tilted radially inwardly into a conical condition so that it could be easily unrolled over the hinge region 6.

FIG. 3 shows a view which is enlarged once again of the rectangular portion identified by D in FIG. 1. FIG. 3 shows the flexible strip 3 which is connected to the cap skirt 2 by way of easily tearable connecting bridge portions 8 and comprises the first portion 4 and the second folded-over portion 5 which is visible in front of the portion 4. The hinge region 6 is indicated at the lower edge of the view in FIG. 3 by a somewhat thicker black line. The second portion 5 has a through aperture 9, in which respect a plurality of such apertures 9 are provided along the periphery of the flexible strip 3 so that the second portion 5 of the flexible strip is effectively divided into a plurality of segments. At the same time, the upper outer edge of the second portion 5 also has extensions 7 which are precisely arranged in such a way that they respectively bridge over a through aperture 9. Those extensions 7 are also present only in the form of individual segments as that segment-like configuration for the extensions 7 is completely sufficient for the purpose for which they are intended. In particular an extension 7 bridges over a through aperture 9 so that the two segment portions of the second portion 5, that are separated by the through aperture 9, are connected together again by way of the extension 7 and thus overall have a higher level of stiffness and resistance to deformation.

The mode of operation in principle of a flexible strip 3 with extensions 7 is described once again and in more readily understandable fashion by reference to the enlarged portion C from FIG. 2, which is shown in FIG. 4. It is possible to see here, in a section which contains the axis 30 of the closure 10 and of the bottle neck 20, the first portion 4 of the flexible strip 3 and the second portion 5 of the flexible strip 3, comprising a plurality of segments 5 respectively separated by a through aperture 9. The cross-section of the portion 2 substantially corresponds to the shape of a right acute-angled triangle with a downwardly disposed capped tip, which blends into the hinge region 6. One of the short sides of the almost right triangle extends vertically and parallel to the inside wall of the first portion 4 while the second side extends substantially horizontally and defines the upper surface 12 of the second portion 5, which is in opposite relationship to the lower, also almost horizontally extending surface 22 of the securing ring 21, and comes into engagement therewith when the closure is unscrewed. The extensions 7 which in cross-section are also in the shape of an acute-angled triangle with a capped tip, that blends into the radially outer edge of the upper surface 12 of the second portion 5, bear against the outside of the securing ring 21 and substantially fill up the annular gap between the inside surface of the first portion 4 and the outside surface of the securing ring 21 and in that way provide for good centering of the flexible strip 3 and also for substantially vertical orientation of the second portion 5, that is to say more precisely for substantially vertical orientation of the longer short side of the triangular cross-sectional shape of the second portion 5. That means that the forces applied to the surface 12 by the surface 22 are exerted substantially perpendicularly to those surfaces and in the longitudinal direction of that second portion 5 which is elongate in cross-section, in which direction the second portion 5 is particularly flexurally stiff and therefore the risk of unrolling thereof can be practically excluded.

The present invention also embraces a variant which is not shown here and which can be so envisaged, on the basis of FIG. 3, that the through aperture 9 terminates before reaching the upper surface 12 or the upper edge of the second portion 5 so that the second portion 5 is not completely divided in the region of the through aperture 9 but the two segments which can be seen to the right and the left of the aperture 9 would still be connected together by a leg extending along the surface 12 so that the upper surface 12 would be an annularly peripherally extending closed flat surface. Independently thereof the extensions 7 could be arranged both at the illustrated position and also at positions in which they do not bridge over the aperture 9 as that is now bridged over by legs which perform a similar connecting function between the segments of the second portion, as was implemented in the above-described embodiments by the extensions 7.

It will be noted that in that case the legs would not have to extend over the full radial thickness of the second portion 5. In that case also however it is preferred if the extensions extend over the through apertures in order still further to improve the stability of the flexible strip.

For the purposes of the original disclosure it is pointed out that all features as can be seen by a man skilled in the art from the present description, the drawings and the claims, even if they are described in specific terms only in connection with certain other features, can be combined both individually and also in any combinations with others of the features or groups of features disclosed here insofar as that has not been expressly excluded or technical aspects make such combinations impossible or meaningless. A comprehensive explicit representation of all conceivable combinations of features is dispensed with here only for the sake of brevity and readability of the description.

The invention claimed is:

1. A screw closure having a tamper-proof strip, wherein the screw closure (10) comprises:

a head plate (1);

an at least approximately cylindrical cap skirt (2) comprising a female screw thread (11); and the tamper-proof strip, the tamper-proof strip being connected to the lower edge of the cap skirt (2) by way of an easily tearable connection (8), the strip being in the form of a flexible strip (3) comprising a first portion (4) directed downwardly from the cap skirt (2) and a second portion (5) which is attached at the lower end of the first portion (4) and which is folded over inwardly and back in the direction of the head plate (1), for engaging behind a securing ring (21) on a container neck (20), wherein at least one extension (7) is provided in axial extension of the second portion (5), the extension (7) being attached to an outer edge of the upper surface (12) of the inwardly folded-over second portion (5) and leaving an inner edge of the upper surface (12) of said second portion (5) free, wherein the second portion (5) extending along the inner periphery of the screw closure has a plurality of apertures (9) provided at approximately equal angular spacing, wherein the extension (7) extends in the peripheral direction over at least one of said plurality of apertures (9) provided in the second portion (5), wherein the extension (7) bears with its radially inner surface against the outer periphery of the securing ring (21) of a container neck while the upper surface (12) of the second portion (5) is in opposite relationship to the underside (22) of the securing ring (21), wherein said tamper-proof strip further comprises a closed ring formed proximate the upper surface (12) of the second portion (5), and wherein said extension (7) is one of a plurality of extensions (7), and each of said plurality of apertures (9) extends to the upper surface (12) of the second portion (5) and is there bridged over by one of said plurality of extensions (7) to thereby form said closed ring.

2. A screw closure as set forth in claim 1, wherein the first portion (4) and the second portion (5) of the flexible strip (3) are connected together by a narrowed material portion acting as a hinge element (6).

3. A screw closure as set forth in claim 1, wherein one of said plurality of extensions (7) bridges over two or more of said plurality of apertures (9).

4. A screw closure as set forth in claim 1, wherein each one of said plurality of extensions (7) bridges over a respective one of said plurality of apertures (9).

5. A screw closure having a tamper-proof strip, wherein the screw closure (10) comprises:

a head plate (1);

an at least approximately cylindrical cap skirt (2) comprising a female screw thread (11); and the tamper-proof strip, the tamper-proof strip being connected to the lower edge of the cap skirt (2) by way of an easily tearable connection (8), the strip being in the form of a flexible strip (3) comprising a first portion (4) directed downwardly from the cap skirt (2) and a second portion (5) which is attached at the lower end of the first portion (4) and which is folded over inwardly and back in the direction of the head plate (1), for engaging behind a securing ring (21) on a container neck (20), wherein at least one extension (7) is provided in axial extension of the second portion (5), the extension (7) being attached to an outer edge of the upper surface (12) of the inwardly folded-over second portion (5) and leaving an inner edge of the upper surface (12) of said second portion (5) free, wherein the second portion (5) extending along the inner periphery of the screw closure has a plurality of apertures (9) provided at approximately equal angular spacing, wherein the extension (7) extends in the peripheral direction over at least one of said plurality of apertures (9) provided in the second portion (5), wherein the extension (7) bears with its radially inner surface against the outer periphery of the securing ring (21) of a container neck while the upper surface (12) of the second portion (5) is in opposite relationship to the underside (22) of the securing ring (21), wherein said tamper-proof strip further comprises a closed ring formed proximate the upper surface (12) of the second portion (5), and wherein said extension (7) is continuous and peripherally extends so as to bridge over every one of said plurality of apertures (9) to thereby form said closed ring.

6. A screw closure as set forth in any one of claims 1, 5, 3, and 4, wherein the second portion (5) is in cross-section approximately in the shape of an acute-angled triangle with a downwardly disposed, cut-off tip, wherein that tip region of the second portion (5) blends into a hinge-like connection (6) to the first portion (4), and the lower end of the extension (7) is connected to an edge of the upper surface (12) of the second portion (5), said edge being the radially outer edge in the folded-over condition of the second portion (5).

7. A screw closure as set forth in any one of claims 1, 5, 3, and 4, wherein the extension (7) is also in cross-section approximately in the shape of an acute-angled triangle with a downwardly disposed, cut-off tip.

8. A screw closure having a tamper-proof strip, wherein the screw closure (10) comprises:

a head plate (1);

an at least approximately cylindrical cap skirt (2) comprising a female screw thread (11); and the tamper-proof strip, the tamper-proof strip being connected to the lower edge of the cap skirt (2) by way of an easily tearable connection (8), the strip being in the form of a flexible strip (3) comprising a first portion (4) directed downwardly from the cap skirt (2) and a second portion (5) which is attached at the lower end of the first portion (4) and which is folded over inwardly and back in the direction of the head plate (1), for engaging behind a securing ring (21) on a container neck (20), wherein at least one extension (7) is provided in axial extension of the second portion (5), the extension (7) being attached to an outer edge of the upper surface (12) of the inwardly folded-over second portion (5) and leaving an inner edge of the upper surface (12) of said second portion (5) free, wherein the second portion (5) extending along the inner periphery of the screw closure has a plurality of apertures (9) provided at approximately equal angular spacing, wherein the extension (7) extends in the peripheral direction over at least one of said plurality of apertures (9) provided in the second portion (5), wherein the extension (7) bears with its radially inner surface against the outer periphery of the securing ring (21) of a container neck while the upper surface (12) of the second portion (5) is in opposite relationship to the underside (22) of the securing ring (21), wherein said tamper-proof strip further comprises a closed ring formed proximate the upper surface (12) of the second portion (5), and wherein the second portion (5) is in cross-section approximately in the shape of an acute-angled triangle with a downwardly disposed, cut-off tip, wherein that tip region of the second portion (5) blends into a hinge-like connection (6) to the first portion (4), and the lower end of the extension (7) is connected to an edge of the upper surface (12) of the second portion (5), said edge being the radially outer edge in the folded-over condition of the second portion (5).

9. A screw closure as set forth in claim 8, wherein each of said plurality of apertures (9) is in the form of a through aperture in the second portion (5) that is spaced apart from said upper surface (12) of said second portion (5) to thereby provide said closed ring.

* * * * *